United States Patent [19]

Salvatore

[11] 4,216,361

[45] Aug. 5, 1980

[54] LOW VOLTAGE VACUUM SWITCH WITH PLURAL CONIC SHIELDS ABOUT THE CONTACTS

[75] Inventor: Leonard A. Salvatore, Watkins Glen, N.Y.

[73] Assignee: Westinghouse Electric Corp., Pittsburgh, Pa.

[21] Appl. No.: 961,789

[22] Filed: Nov. 17, 1978

[51] Int. Cl.[3] ..... H01H 33/66

[52] U.S. Cl. ..... 200/144 B

[58] Field of Search ..... 200/144 B, 144 R, 304, 200/305

[56] References Cited

U.S. PATENT DOCUMENTS

| | | | |
|---|---|---|---|
| 1,819,154 | 8/1931 | Eschholz | 200/144 B |
| 2,863,027 | 12/1958 | Jennings | 200/144 B |
| 2,943,167 | 6/1960 | Hughes et al. | 200/83 |

FOREIGN PATENT DOCUMENTS

| | | |
|---|---|---|
| 351809 | 4/1922 | Fed. Rep. of Germany . |
| 2260587 | 6/1974 | Fed. Rep. of Germany . |
| 1093231 | 11/1967 | United Kingdom . |
| 12044587 | 9/1970 | United Kingdom . |
| 1262385 | 2/1972 | United Kingdom . |

*Primary Examiner*—James R. Scott
*Attorney, Agent, or Firm*—W. G. Sutcliff

[57] ABSTRACT

An improved low voltage vacuum switch is detailed which is operable to interrupt high D.C. continuous currents at voltages below the arc potential. An improved arc shield is provided which ensures that the switch can withstand significant D.C. overvoltages across the contacts when the switch is in the open position, even after repeated switch operation. The arc shield means comprises spaced-apart generally conic shield extending in parallel relationship from opposed ends of the switch with substantial overlap of the conic shields. These conic shields are disposed at an angle relative to the switch axis and minimize the chance for vaporized contact material to reach and condense upon the switch insulator body portion.

7 Claims, 2 Drawing Figures

LOW VOLTAGE VACUUM SWITCH WITH PLURAL CONIC SHIELDS ABOUT THE CONTACTS

BACKGROUND OF THE INVENTION

The present invention relates to low voltage vacuum switches which are typically used in electrolytic chemical processing plants. The switches are used as shorting switches for shunting around a single series-connected electrolytic cell. Numerous such electrolytic cells are connected electrically in series to a D.C. plant power supply which provides several thousand amperes continuous current and an overall supply voltage of up to about 400 volts D.C. Since these cells are series-connected, and there may be up to about 100 such cells in series with approximately equal resistive characteristics, the voltage across an individual cell is about 4 volts D.C.

The vacuum switches are shunting switches for bypassing an individual cell without shutting down the plant. When a vacuum switch is in the closed contact position, effectively shunting the cell across which it is connected, about 4,000 amperes of D.C. current will be carried continuously through the switch, with the typical 4 volt D.C. potential across the switch. The shunted cell can then be electrically isolated from the system to permit inspection and maintenance. When the cell is to be put back into operation the vacuum switch is opened by moving the contacts apart. A high current, low voltage D.C. arc will burn for a short period within the vacuum switch. This arc will be extinguished when the contacts are sufficiently separated since an arc cannot be maintained in the vacuum switch when the potential across the switch contacts is below a characteristic switch contact arc voltage. For most materials this is about 15–20 volts D.C.

The high current arc which burns within the vacuum switch is typically extinguished in about twenty milliseconds. The contact material can be selected from any of the well known high conductivity materials such as high conductivity copper or copper-alloys which have low contact resistance in the closed switch position, and low weld strength for ease of switch opening. When the high current arc burns during switch openings, contact material is vaporized from the contact surfaces. Some of this vaporized contact material will condense on the interior surface of the switch envelope.

A low voltage vacuum shorting switch is described in application Ser. No. 650,322, filed Jan. 19, 1976 now abandoned in favor of continuing application Ser. No. 915,324 filed June 13, 1978. This switch comprises a pair of flexible annular corrugated diaphragms which are sealed to an annular insulating ring-like body at the diaphragm outer perimeters. A pair of opposed cylindrical conductive contacts are sealed through the inner perimeters of the respective diaphragms to complete the hermetically sealed switch envelope which is at least partially evacuated.

In copending application Ser. No. 928,640, filed July 27, 1978, this earlier low voltage vacuum switch was modified with an internal annular arc shield disposed within the switch between the contacts and the annular insulating body portion. This annular arc shield greatly reduced the deposition of vaporized contact material upon the annular insulating body portion of the switch which electrically isolates the switch ends when the contacts are in the open position. In one embodiment of the shielded low voltage switch a pair of overlapping members formed the arc shield. These overlapping members were annular and disposed concentric about the switch axis, but with the annular members directed parallel to the switch axis.

It has been discovered that after repeated operations some contact material does deposit behind the annular arc shield as evidenced by measuring the resistance along the annular ceramic insulating body. For a new switch, this resistance will be of the order of greater than one megohm. For a switch with an annular arc shield after about 50 switching operations the resistance across the annular insulator may be from several hundred to several thousand ohms.

It has been discovered that during certain unusual electrolytic cell conditions, when the vacuum shunting switch is in the open position, it is possible for the full plant power supply voltage, of up to about 400 volts D.C., to be applied across the switch. If there has been significant contact material deposited on the annular insulating body inner surface establishing a relatively low resistance path along the insulator, then a breakdown can occur across the vacuum switch. This can result in damage to the switch.

SUMMARY OF THE INVENTION

A low voltage vacuum shorting switch has been provided with improved arc shielding means which greatly reduces conductive deposits upon the inner surface of the annular insulating body portion of the switch. The improved arc shielding means comprises two concentrically spaced-apart generally conic shields. An inner conic shield extends from one of the cylindrical contacts toward the opposed flexible corrugated envelope portion. An outer conic shield extends from one end of the annular insulating member toward the opposed flexible corrugated envelope portion. The inner and outer conic shields substantially overlap and extend parallel to each other at an angle relative to the switch axis. This arc shield structure requires that vaporized contact material follow a tortuous S-shaped path before it can react and condense upon the annular insulating body portion. It has been discovered that with this arc shield structure the switch can be operated several hundred times at very high currents, and the resistance measured along the annular insulator will be maintained at above one megohm. There will be no switch breakdown even at voltages of 400 volts D.C. applied across the switch.

BRIEF DESCRIPTION OF THE DRAWINGS

FIG. 2 is a side elevation view partly in section of an alternate embodiment low voltage vacuum shorting switch with the two concentrically spaced-apart generally conic shields, and a disc end baffle shield at the opposed end of the switch from which the inner conic shield extends from.

DESCRIPTION OF THE PREFERRED EMBODIMENTS

Figure 1:
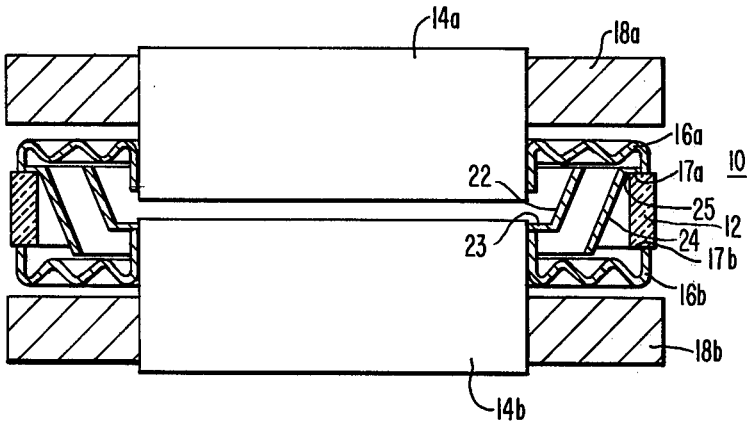
FIG. 1 is a side elevation view partly in section of the low voltage vacuum shorting switch of the present invention with the two concentrically spaced-apart generally conic shield.
Figure 2:
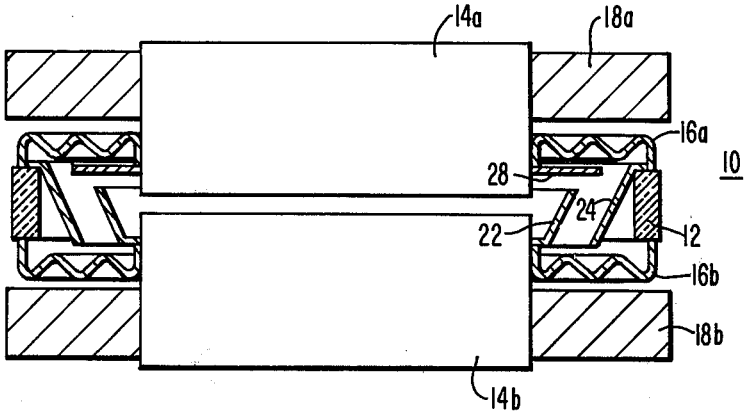

The invention can be best understood by reference to the exemplary embodiments of FIGS. 1 and 2. The low voltage vacuum shorting switch 10 comprises an annular insulating body 12 which is preferably ceramic. A pair of cylindrical conductive contacts 14*a*, 14*b* and a pair of flexible annular corrugated diaphragm members 16*a*, 16*b* along with annular insulator 12 form the switch envelope. The inner perimeter of respective diaphragm members 16*a*, 16*b* is brazed to the respective cylindrical contact 14*a*, 14*b* which passes through the diaphragm members.

A metallized surface is provided on each the opposed end faces 17*a*, 17*b* of the annular insulator 12, and the outer perimeter of the diaphragm members 16*a*, 16*b* are sealed by brazing to these metallized surfaces 17*a*, 17*b*. Planar conductive end plates 18*a*, 18*b* are mounted on respective ends of the cylindrical contacts 14*a*, 14*b* to permit electrical connection of the switch to electrical bus bars. This bus permits the switch to shunt the electrolytic cell across which the switch is connected.

The arc shield means 20 comprises inner conic shield 22 and outer conic shield 24 which are concentrically spaced apart with the switch. The inner conic shield 22 has a support leg 23 which is connected to and supported from one cylindrical contact 14*b*. The inner conic shield 22 extends from this support leg 23 at an angle with respect to the switch axis toward the opposed flexible diaphragm 16*a*. The angle between the support leg 23 and the conic shield is about 60 degrees, so that the conic shield extends at an angle of about 30 degrees with respect to the switch axis.

The outer conic shield 24 has a support leg 25 which is connected to the metallized surface 17*a* on the end face of the annular insulator. The outer conic shield 24 extends parallel to inner conic shield but in the opposite direction toward the flexible diaphragm 16*b*.

The parallel, spaced-apart inner and outer conic shields overlap over a substantial portion of their lengths, and thus provide a tortuous S-shaped path between the arc contacts and the annular insulator body.

Vaporized contact material sputtered outward from the arc between the contacts as they are opened to the position seen in FIG. 1 will be deflected by the inner conic shield 22 toward the flexible diaphragm 16*a*. Any contact material which does not condense on the diaphragm 16*a* would tend to condense on the conic shields, and would have to be deflected off the opposed diaphragm 16*b* before it could possibly reach the inner surface of the annular insulator to be condensed thereon.

The support leg 25 associated with outer conic shield 24 should be relatively short so that the gap between the annular insulator 12 and the outer conic shield 24 at least at the end where support leg 25 extends will be a very small gap. This further ensures that no vaporized contact material can be deposited along the length of the inner surface of annular insulator 12.

The inner and outer conic shields 22 and 24 are preferably metal members which have a thermal expansion characteristic which is compatible with the braze connection of the support leg 25 to the metallized end surface of the annular insulator. A particularly advantageous metal for use as the shields 22 and 24 is a high nickel content nickel-iron alloy, such as the 42–46% nickel-alloy "Niromet", a trademarked alloy of W. B. Driver Co.

The open contact position spacing between the arcing surface ends of the cylindrical contacts is about 0.125 inch or 3.175 millimeter. The spacing between conductive portions of the switch which are connected to opposed sides of the switch should exceed the 0.125 inch or 3.175 millimeter spacing and is typically about 0.1875 inch or 4.7625 millimeter. Thus, the conic shields 22, 24 are parallel but spaced apart by this dimension. The ends of the respective conic shields are likewise spaced from the opposed diaphragm members 16*a*, 16*b* by this same dimension. These spacings ensure there is no arcing path across the switch. The extending ends of the respective conic shields 22 and 24 can be positioned over a concave corrugated annular ridge in the diaphragm toward which it is directed to provide convenient spacing within a very compact structure.

In another embodiment of the invention seen in FIG. 2 the switch structure is basically the same as in FIG. 1, with the addition of a disc-like annular baffle 28. The annular baffle 28 is connected to and supported from that cylindrical contact 14*a* which is opposite from the one 14*b*, from which the inner conic shield is mounted and extends. The baffle 28 is a protective baffle over diaphragm 16*a* from which it is closely spaced. Vaporized contact material directed by inner conic shield 22 will impinge baffle 28 rather than the flexible diaphragm 16*a*, and will tend to be condensed on the baffle 28. For the typically compact switch with a short axial length; the inner conic shield could be shortened in length somewhat to permit sufficient room for and spacing from the baffle 28.

The conic shape of the overlapping members which form the arc shield gives these members structural rigidity which serves to keep them properly positioned and spaced during the high temperature fabrication process.

The inner shield member is preferably connected to the conductive contact which is electrically connected to the more positive potential input side of the cell. The sputtered contact material is generally from the more positive potential contact, or anode side of the switch, as a result of electron bombardment of this contact. The connected inner shield will be in close proximity to the source of sputtered material as a condensation surface.

I claim:

1. A vacuum switch for direct current electrolytic cell shunting operation, which switch is operable with the contacts closed at a high amperage D.C. continuous current, and which will interrupt this continuous current when the contacts are opened at a D.C. voltage across the contact which is below the voltage at which an arc can be sustained between the contacts within the vacuum switch, which switch comprises an annular insulating body portion, a pair of flexible corrugated envelope portions, and a pair of cylindrical conductive contact members sealed to the inwardly extending periphery of the respective annular flexible corrugated envelope portions, and the outwardly extending periphery of each annular flexible corrugated envelope portion is sealed to opposed ends of the annular insulating body portion, and wherein arc shield means are disposed within the switch between the contact end surfaces and the annular insulating body portion, which arc shield means comprises two concentrically spaced-apart generally conic shields, with an inner conic shield extending from one of the cylindrical contacts, and an outer conic shield extends from one end of the annular insulating member, with the inner and outer conic shields substantially overlapping and extending parallel to each other at an angle relative to the switch axis.

2. the vacuum switch set forth in claim 1, wherein the inner shield is connected to the conductive contact which is electrically connected to the more positive potential input.

3. The vacuum switch set forth in claim 1, wherein a disc-like annular shield extends radially outward from the cylindrical contact opposed to that cylindrical contact from which the inner conic shield extends, which disc-like annular shield is spaced between the extending end of the inner conic shield and the annular flexible corrugated envelope portion toward which the inner conic shield extends.

4. The vacuum switch set forth in claim 1, wherein the inner and outer conic shields are formed of a conductive material which has a thermal expansion characteristic similar to that of the annular insulating body portion.

5. The vacuum switch set forth in claim 1, wherein the annular insulating body portion is ceramic and the inner and outer conic shield conductive material is a high nickel content nickel-iron alloy.

6. The vacuum switch set forth in claim 1, wherein after repeated operation the switch is capable of withstanding breakdown when a D.C. voltage of several hundred volts is applied across the opened contacts.

7. The vacuum switch set forth in claim 1, wherein the inner and outer conic shields are inclined at an angle of about 30 degrees with respct to the switch longitudinal axis.

* * * * *